US006060987A

United States Patent [19]

Marlia

[11] Patent Number: 6,060,987

[45] Date of Patent: May 9, 2000

[54] RETROFITTABLE DEVICE TO WARN OF REFRIGERATOR DOOR-AJAR CONDITION

[76] Inventor: Kim Marlia, 2711 McAllister St. #D, San Francisco, Calif. 94118

[21] Appl. No.: 09/306,561

[22] Filed: May 6, 1999

[51] Int. Cl.[7] ..... G08B 21/24

[52] U.S. Cl. ..... 340/540; 62/129; 340/529; 340/545.6; 340/585; 340/693.5; 340/693.9

[58] Field of Search ..... 340/585, 540, 340/529, 530, 693.5, 693.9, 693.12, 589, 545.6; 62/129

[56] References Cited

U.S. PATENT DOCUMENTS

| | | | |
|---|---|---|---|
| 2,302,072 | 11/1942 | Tickell | 340/585 |
| 4,365,237 | 12/1982 | Knight | 340/586 |
| 4,566,285 | 1/1986 | Tershak et al. | 62/129 |
| 4,717,910 | 1/1988 | Scripps et al. | 340/586 |
| 4,812,827 | 3/1989 | Scripps | 340/586 |
| 4,963,854 | 10/1990 | Stuecker | 340/693.5 |
| 5,070,319 | 12/1991 | Scuka | 340/545.6 |
| 5,451,930 | 9/1995 | McDaniel | 340/585 |
| 5,479,152 | 12/1995 | Walker et al. | 62/129 |
| 5,619,185 | 4/1997 | Ferraro | 340/693.1 |

FOREIGN PATENT DOCUMENTS

| | | |
|---|---|---|
| 1517858 | 1/1968 | France . |
| 2623315 | 11/1987 | France . |
| 3248799 | 7/1984 | Germany . |

OTHER PUBLICATIONS

Anon. "Refrigerator alarm", *Elektor Publishers Ltd.,* vol. 2, No. 11, p. 1141 (Nov. 1976).

*Primary Examiner*—Glen Swann
*Attorney, Agent, or Firm*—Flehr Hohbach Test Albritton & Herbert LLP

[57] ABSTRACT

A device that is retrofittably adapted to a refrigerator warns of a refrigerator door ajar condition. The normal refrigerator internal light is removed and the device is fitted into the light fixture. The light may then be affixed to the device. The device thus receives AC potential each time the refrigerator door is ajar. A time interval counter measures how long the door is ajar, and if a predetermined time interval is exceeded, a alarm is given. The device may also monitor internal refrigerator storage space temperature and sound an alarm when the refrigerator door is ajar if internal temperature is high, to alert of perhaps impending failure. The alarm may include audible, visual, and wirelessly transmitted signals.

20 Claims, 4 Drawing Sheets

RETROFITTABLE DEVICE TO WARN OF REFRIGERATOR DOOR-AJAR CONDITION

FIELD OF THE INVENTION

This invention relates to warning devices in general, and specifically to devices that warn when a refrigerator door remains open longer than a predetermined period.

BACKGROUND OF THE INVENTION

Commercial and consumer refrigerators do an excellent job of maintaining a refrigerated storage space at a cold temperature, providing the refrigerator access door is not left open too long. When the refrigerator door is closed, the refrigerated storage space is essentially hermetically sealed from ambient air. Under these conditions, the refrigeration mechanism can maintain the storage space at a desired low temperature.

However, if the door is left open too long, foodstuffs within the storage space can spoil. Further, the refrigeration mechanism itself can be damaged as it attempts to restore a cold temperature to a storage space that is now exposed to warmer ambient air.

Several devices are known in the art to alert a user that the door to a refrigerator is ajar or completely open. U.S. Pat. No. 2,302,072 (1939) to Tickell discloses a portable battery operated flashlight-like device that is placed inside a refrigerator storage space. A thermostat associated with the device senses storage space temperature and causes a light (or an audible alarm) in the device to turn on when the temperature becomes too high. Unfortunately Tickell's device is rendered useless when the batteries fail.

U.S. Pat. No. 5,451,930 (1995) to McDaniel discloses a rather more sophisticated device that senses both a door ajar condition and a too high refrigerator temperature, and can activate at least one alarm when either condition is sensed. Unfortunately McDaniel's device is relatively expensive to produce and requires professional installation because it requires tapping into electrical switches within the refrigerator. While McDaniel's device might be incorporated into a new refrigerator during manufacture (assuming one could justify the device cost), the device is not readily retrofittably attached to an existing refrigerator, especially by a layperson.

In summary, while door ajar detection devices are known, the devices typically require batteries and are not failsafe (e.g., Tickell '072), or are expensive and cannot readily be installed by a layperson in an existing refrigerator. Thus, there is a need for a door ajar detector that does not require batteries, is inexpensive to fabricate, and can be retrofitted to an existing refrigerator by a layperson. Preferably such device should optionally signal when refrigerator temperature has become too high.

The present invention provides such a device.

SUMMARY OF THE INVENTION

Refrigerators include an internal light bulb that attaches to a socket within the refrigerator and is activated by an on-off switch to illuminate the storage space when the refrigerator door is open. The present invention utilizes this feature. The present invention is a refrigerator door ajar warning device that includes a housing having a light bulb sized male plug connector and a light-bulb sized female socket connector. The refrigerator light bulb is removed from its normal socket within the refrigerator, and the male connector of the present invention is attached to that socket. The refrigerator light bulb is then attached to the female socket on the device housing. (Of course for safety reasons, the light bulb may be connected to the device housing female socket before the device male connector is attached to the normal refrigerator socket.) The device is thus retrofittably installable into a refrigerator, even by a layperson.

The device includes circuitry within the housing that senses the presence of AC-voltage at the male connector, which is to say, senses the presence of a refrigerator door ajar or open condition. The circuitry determines from the presence of the AC-voltage whether the refrigerator door has remained unclosed for more than a predetermined time. If so, the circuitry sounds at least one alarm that is preferably housed with the device. If desired, the device can further include a sensor to determine temperature within the storage space, and can include associated memory to store sensed temperature. Upon being energized when the refrigerator door is open, such device can sound an alarm when storage space temperature rises too high, e.g., due to a refrigeration mechanism malfunction.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
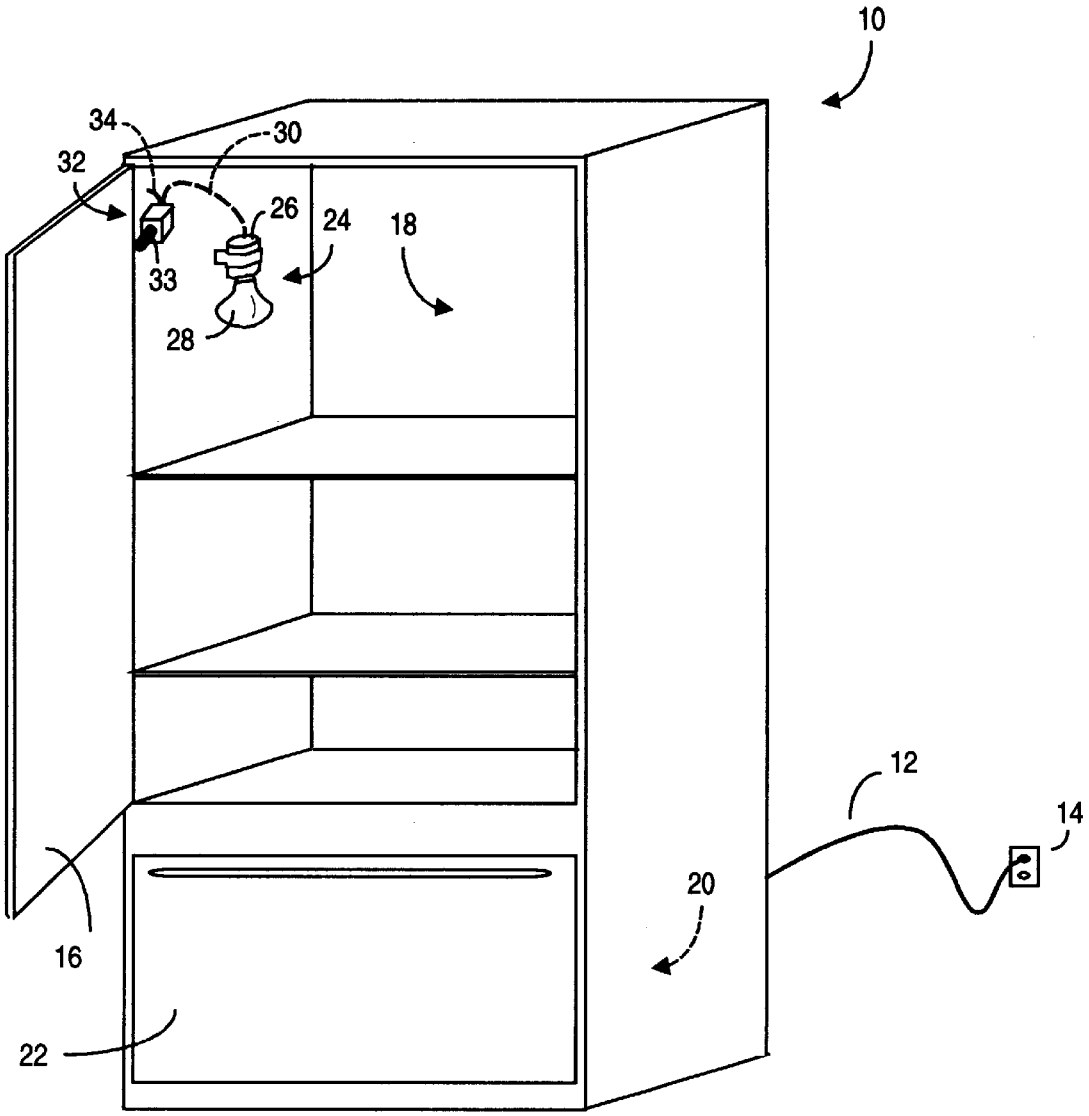
FIG. 1 (PRIOR ART)
FIG. 1 depicts a generic refrigerator, according to the prior art.

FIG. 1 depicts a conventional refrigerator 10 connected by an AC power cord 12 to a source of AC operating voltage, for example a wall socket 14. The refrigerator access door 16 is shown open exposing a normally cooled storage compartment 18. Frequently refrigerator 10 will include a second normally cooled storage compartment 20, access to which is gained by opening a second door 22. Not shown in FIG. 1 is the refrigeration cooling mechanism that actually cools the storage compartments.

Refrigerator 10 includes an illumination unit 24 typically comprising a female socket 26 into which an illumination source 28 may be attached to make electrical connection. Socket 26 typically is connected by electrical wires 30 and 34 to power source 14 via an on-off switch unit 32. Commonly switch 32 includes a projecting plunger 33 that is urged into the switch by an interior portion of door 16 when the door is closed. The plunger is spring-biased and moves outwardly away from the switch when door 16 is at least ajar, e.g., at least slightly open if not more fully open.

When door 16 is ajar, outwardly projecting plunger 33 closes switch 32 electrically. AC voltage from source 14 is thereby coupled to energize light 28, which illuminates the interior 18 of the refrigerator. On the other hand, when door 16 is closed, plunger 33 is urged into switch 32, opening the electrical path. Thus, with the door closed, switch 32 no longer couples AC power to socket 26, and light 28 is not energized and will be off.

The present invention recognizes that when the refrigerator door is ajar, electricity is coupled to socket 26 to energize light 28. Conversely, when the refrigerator door is closed, socket 28 does not receive electricity, due to the open-circuit condition of switch 32.

Figure 2:
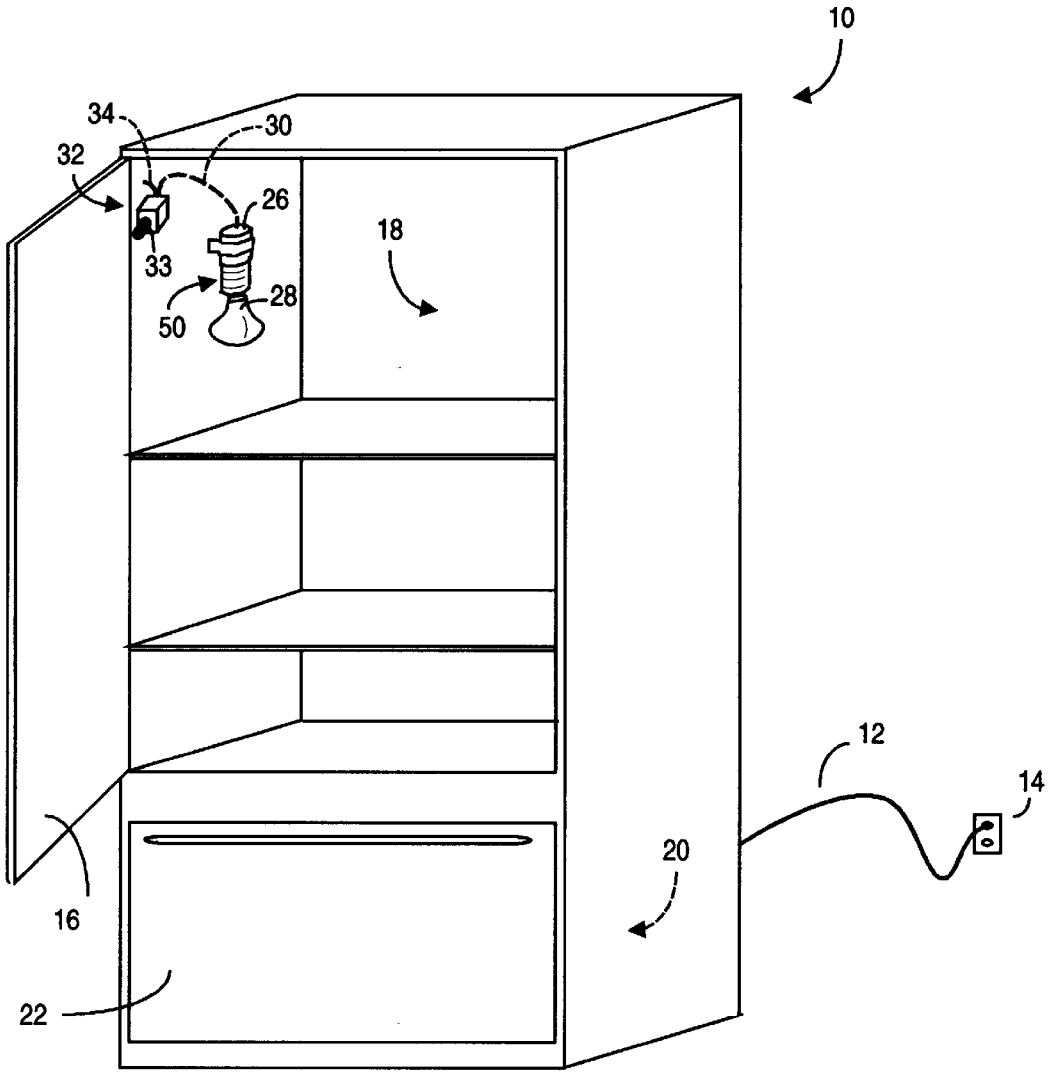
FIG. 2 depicts a generic refrigerator provided with the present invention.

Referring now to FIG. 2, the present invention 50 is shown attached to socket 26 within generic refrigerator 10, such as was described with respect to FIG. 1. Attachment or connection between the present invention 50 and socket 26 is such that the invention receives AC operating potential (from source 14 via wires 12, 34, 30 and switch 32) when door 16 is ajar. Conversely, switch 32 causes the present invention to receive no operating potential when door 16 is closed.

For purposes of the present invention it suffices that refrigerator 10 have a switch unit 32 that couples AC operating potential to a socket 26 when an access door 16 is open, and that deprives the socket of AC operating potential when the door is closed. Whether light 28 is a light bulb (incandescent or otherwise) having a conventional "screw-in" base, or a bayonet mount base, or other type of base is not important. Of course light 28 will have a base that matingly attaches with socket 26 to provide electrical potential to the light when door 16 is open.

Thus, although FIGS. 1 and 2 depict a consumer type refrigerator having two storage compartments, it is to be understood that for purposes of the present invention, refrigerator 10 may be otherwise configured. It may, for example, be a commercial refrigerator whose storage compartment(s) may be large enough for a person to walk into. The important feature is a socket 26 that provides AC potential when the access door to the refrigerator is ajar, and that does not provide such potential when the access door is properly closed.

Figure 3:
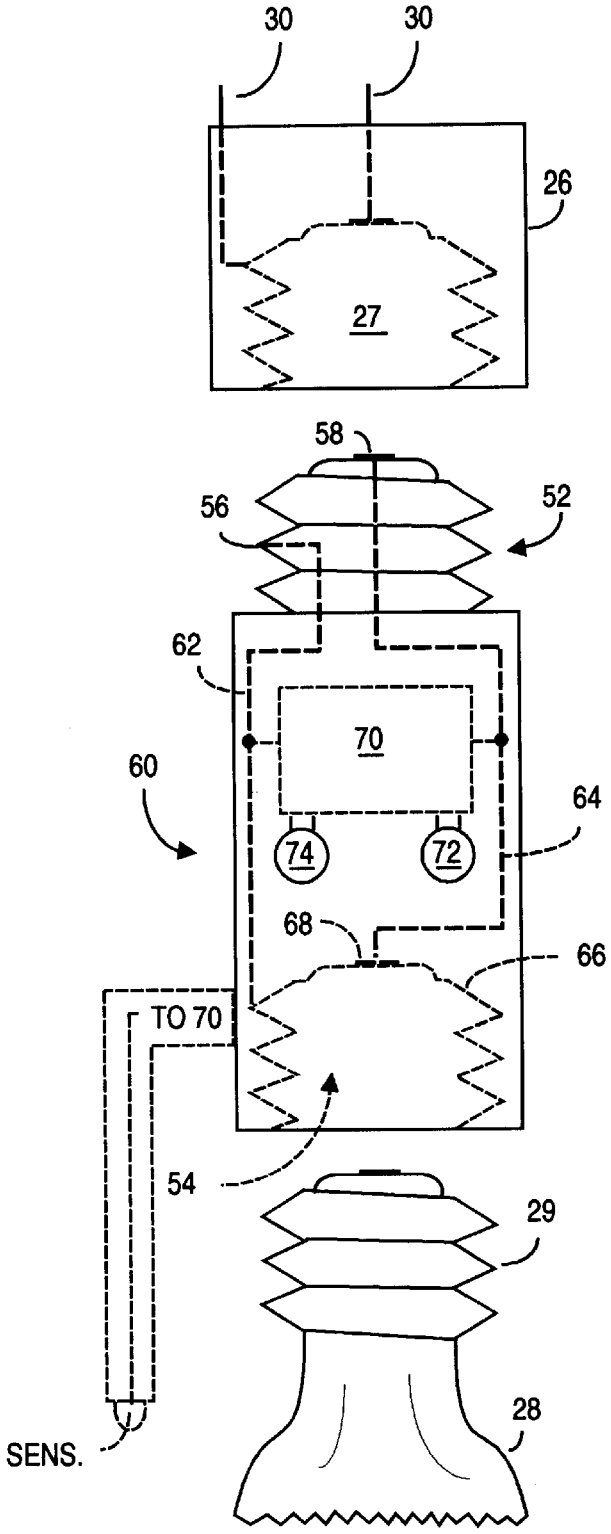
FIG. 3 is a functional cross-sectional schematic depicting cooperation between the present invention, and an existing light socket in a generic refrigerator.

FIG. 3 depicts the present invention 50 as yet unconnected to socket 26. In the embodiment shown, light 28 has a screw-type base 29 and accordingly socket 26 will have a mating screw type base 27. Understandably, if socket 26 provided a bayonet-type connection, then light 28 would of course have a bayonet-type plug. Similarly, if socket 26 provided two spaced-apart female type connectors, then light 28 would have a base that provided two spaced-apart male type projections, and so forth.

Within the context of the present invention, a housing 60 is provided to which is attached a male type plug 52 that is sized to matingly fit into the female receptacle 27 provided by socket 26. By the same token, housing 60 also provides a female type receptacle 54 sized to matingly accept the base 29 of the light 28 that is normally used with the refrigerator. If socket 26 provided a female bayonet-type receptacle 27, then the present invention will provide a bayonet-type plug 52. To accommodate the very same (bayonet-type) light 28, the present invention will also provide a bayonet-type socket 54. As noted, other socket and plug types may be used.

It will be appreciated from the foregoing that installing the present invention is rather simple and can be done by a layperson. Light 28 is unscrewed or otherwise disconnected from socket 26. In its place, plug 52 of the present invention is screwed or otherwise connected to socket 26. Although the light is not necessary to operation of the invention, the base 29 of light 28 may now be screwed or otherwise connected to socket 54 of the present invention. (Of course the light could be attached to socket 54 before plug 52 is attached to refrigerator socket 26.) From the foregoing description it will be appreciated that the present invention 50 is placed mechanically in series between refrigerator socket 26 and refrigerator lamp 28, and that electrically it is placed in parallel between refrigerator socket wires 30.

Those skilled in the art will appreciate that electrically the present invention could be configured to operate in series with refrigerator socket wires 30. However such operation is not failsafe in that if light 28 failed (e.g., perhaps light 28 is an incandescent bulb whose filament burns out) then no electricity will be provided to the present invention.

The parallel electrical connections provided by the present invention are self-evident from FIG. 3. The central lead of socket 26 will make electrical connection with center connection (or pin or electrode, depending upon the configuration) of plug 52 connected to housing 60 of the present invention. Similarly, the outer lead of socket 26 will make electrical connection with the outer shell (or pin or electrode) of plug 52. Within housing 60, wires 62 and 64 make electrical connection between plug 52 and receptacle 54.

Thus, when housing 60 is attached to socket 26, specifically by mating plug 52 to receptacle 27 in refrigerator socket 26, whatever electricity may be present between socket wires will be coupled by wires 62 and 64 to socket 54 connections 66 and 68. If the base 29 of light 28 is now attached to receptacle 54, when refrigerator door 16 is ajar, AC potential will be present at leads or wires 30, and light 28 will illuminate. By the same token, when the refrigerator door is closed, refrigerator switch 32 will open-circuit preventing operating potential from appearing at wires 30, or at base receptacle 54 of the present invention, with the result that light 28 will be turned off.

As shown in FIG. 3, within housing 60 is an electrical circuit 70 effectively connected in parallel between refrigerator socket wires 30. When the refrigerator door is ajar, circuit 70 will receive AC operating potential (typically 115 VAC or 220 VAC) and when the refrigerator door is closed, circuit 70 will not receive operating potential. Connected to circuit 70 will be at least one signal transducer 72 and/or 74 preferably attached to or within housing 60.

Although the preferred embodiment uses a parallel electrical connection to the refrigerator socket, one could alternatively couple the present invention in series electrically with refrigerator wires 30. However such configuration is not failsafe because if electrical conductivity through light 28 fails, no electrical power will be provided to the present invention when the refrigerator door is ajar. Such conductivity failure could result, for example, from an open light filament, or a light (incandescent or otherwise) not tightly coupled to receptacle 54. Further, it will be appreciated that the parallel configuration will function whether or not the light is present. A series configuration requires the present of a functioning (e.g., capable of electrical conduction) light 28.

In practice, when the refrigerator door is ajar, circuitry 70 detects such condition by the continuing presence of AC potential between leads 62, 64. If AC potential is sensed for longer than a predetermined time (that may be made user-adjustable), circuitry 70 will generate and couple an alert signal to transducer 72 and/or 74. The transducer(s) can enunciate the door ajar condition to nearby persons. Transducer 72 may, for example, be a sound generator that can generate many dB of warning signal to command the attention of persons within a few hundred feet to come to the refrigerator and attend to the problem, e.g., to fully close the refrigerator door.

Shown in phantom in FIG. 3 (and FIG. 4) is a sensor ("SENS"), a portion of which is external to the device housing. SENS may be a heat sensor, e.g., a thermistor, and/or a light sensor, e.g., a photocell. This sensor is coupled by wire(s) to circuitry 70. If light 28 is present and functioning (e.g., not burnt out and securely attached to the receptacle 54), then when the refrigerator door is ajar, light 28 will turn on and will generate heat, especially if light 28 is an incandescent bulb. The SENS unit will detect and respond to the presence of heat. A thermistor sensor, for example, will change resistance, and may be coupled in series with a fixed resistor between a voltage present within circuitry 70 when the refrigerator door is ajar. The voltage drop across the fixed resistor or the thermistor can detected by circuitry 70. For example, if it is known that a 60 W incandescent bulb when turned on for more than say 100 seconds will cause a voltage drop of at least 3 V, circuitry 70 can signal an alarm when the detector voltage drop exceeds 3 V, which is to say, when the refrigerator door has been ajar for at least about 100 seconds. If desired, a user accessible potentiometer could be provided to permit adjusting the threshold: the refrigerator door could be left ajar and the potentiometer adjusted to cause an alarm to signal after a predetermined door ajar time. Unfortunately it will be appreciated that if light 28 fails (e.g., burns out or is not securely electrically connected to the present invention), then sensing door ajar time as a function of light heat will fail. Thus, such heat sensing is not failsafe.

It will also be appreciated that under certain circumstances, if SENS is a light sensor, a door ajar condition can be sensed in terms of sensor detected light. When the refrigerator door is closed, SENS will see darkness. When the refrigerator door is ajar, light 28 (if present and working) will illuminate, which light can be sensed. Circuitry 70 can sense from the sensor how long a light condition (as opposed to a door-closed dark condition) is present. If the light condition is present for longer than a desired threshold (e.g., perhaps 100 seconds) then circuitry 70 can signal an alarm. However it will be appreciated that light sensing is not failsafe. If light 28 fails, the light sensing embodiment could still detect a door ajar condition only if ambient light in the kitchen or other area containing the refrigerator were relatively bright. A door ajar condition at night would go undetected.

Thus, although the present invention may be coupled in series rather than parallel to the refrigerator light socket, and may sense the time the refrigerator door is ajar using heat and/or light sensing, none of these embodiments is failsafe, in contrast to the preferred embodiment.

Figure 4:
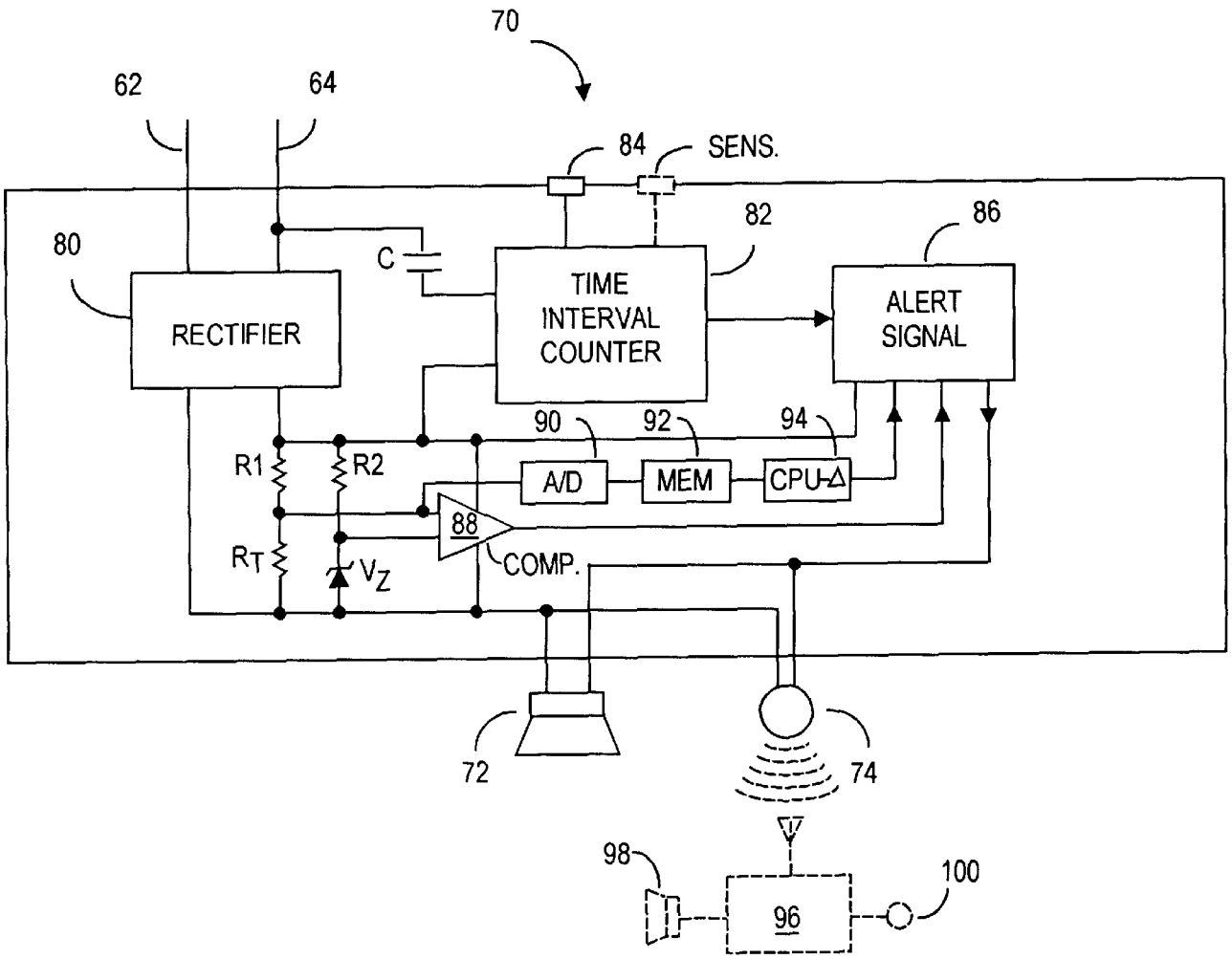
FIG. 4 is a schematic diagram of a preferred embodiment of the present invention.

FIG. 4 depicts a generic block diagram of circuitry 70. AC potential will be present between incoming leads 62 and 64 whenever and for however long door 16 is ajar, as sensed by switch 32. Incoming AC on lines 62, 64 signify that the refrigerator door is ajar. The raw AC may be rectified by a rectifier circuit 80, which may be as simple as a diode and capacitor, to provide DC potential for operating other portions of circuitry 70, for example a time interval counter 82 and/or an alert signal generator 86.

Time interval counter 82 essentially determines the approximate length of time that AC is present between incoming leads 62 and 64, which is to say, the approximately amount of time the refrigerator door remains ajar. If desired a control 84 can be provided to permit a user, perhaps the refrigerator owner, to manually adjust or set a permissible predetermined time period, beyond which an alarm is to be sounded. For example, in normal household use, a refrigerator door might intentionally be open for as long as perhaps 60 to 100 seconds, during which time food is being placed in the refrigerator. Beyond this (or some other predetermined) time period, it may be assumed the refrigerator door has been left ajar.

The time interval counter may be implemented using analog and/or digital techniques. Time interval counter may be as simple as a resistor and capacitor coupled in series between the rectified voltage from rectifier 80. As such, a current (albeit not necessarily a constant current) flow through the resistor would cause an increase in voltage across the capacitor. The longer the current flowed, the greater the potential across the capacitor. If a potential across the capacitor exceeds a given threshold, which corresponds to perhaps a door ajar period exceeding say 100 seconds, the voltage-over-threshold condition can be coupled to a circuit 86 that will generate an alarm signal. At one level of sophistication, the threshold detection could include an operational amplifier having one input coupled to a reference potential, perhaps from a Zener diode, and the other input coupled to receive the capacitor ramp-like voltage. If desired, control 84 could be a potentiometer that varies a portion of the current source resistor, which would vary the approximate length of time needed for the ramp voltage to attain a given threshold magnitude. In a less sophisticated time interval counter circuit, the threshold voltage could instead be a scaled potential required to turn-on a switch, perhaps a MOS or bipolar device, whose output is coupled to the alert signal generator 86. If desired, unipolar voltage pulses could be generated from rectified AC and integrated to generate a pulsating DC level whose magnitude would be a function of the length of time the refrigerator door was ajar. If the generated voltage magnitude exceeded a predetermined threshold, then an alarm signal should be sounded as it is known that the refrigerator door has been ajar too long. Those skilled in the art of circuit design will appreciate that many techniques may be used to measure time interval given the presence of a steady frequency AC signal during such interval.

If desired, time interval counter 82 may include a digital counter, coupled to receive an AC-coupled version of voltage at say line 64. The counter would then count cycles of the typically 60 Hz signal present when the refrigerator door is ajar. For example, a count of say 6,000 cycles would represent a time interval of about 100 seconds. In such embodiment, control 84 might be used to switch logic gates to select a predetermined count beyond which counter 82 would output a signal to alert signal generator 86.

As noted, a less failsafe method of determining a door ajar time period can be implemented using a heat and/or light sensor, SENS. The use and configuration for detecting heat and light using such sensors is well known in the art, and for that reason, bias circuitry and voltage references and voltage comparitor circuits are not described herein.

Alert signal generator 86 may be an oscillator circuit operating at an audible frequency, perhaps 1 KHz, that provides an output for as long as the time interval counter determines the predetermined time value continues to be exceeded. One output from generator 86 might be coupled to an acoustic transducer 72 mounted on or within housing 60 of the present invention. When the refrigerator door has remained ajar for too long, e.g., perhaps longer than 100 seconds in the above example, transducer 72 would enunciate with a loud perhaps oscillatory sound to summon anyone within hearing range. If desired, a visual transducer 74, perhaps a light emitting diode, could be provided.

If desired, a preferably passive temperature transducer such as a thermistor $R_T$ can be included to provide a measure of temperature within the refrigerator storage space.

Although other transducers may of course be used, $R_T$ will change in impedance as a function of internal refrigerator temperature. When the refrigerator door is ajar or open, the voltage drop across $R_T$ will be proportional to refrigerator storage space temperature. This voltage drop may be compared to a reference voltage, perhaps from a Zener diode $V_Z$ to determine whether internal temperature is presently acceptably cold. A comparator 88 may be used, when operating potential is available when the refrigerator door is ajar or open, to determine when the storage space temperature is too high. The output from comparator 88 may be used to trigger an alert signal from unit 86, preferably using a tone or tone pattern different from the door-ajar warning signal. Thus, even though the refrigerator door is properly closed most of the time, the refrigeration unit itself may be failing to maintain a sufficiently cold interior temperature. The ability to sound a warning signal when such condition is detected may enable the refrigerator owner to attend to necessary repairs before the refrigeration unit fails totally.

A more sophisticated device 70 may include circuitry to track or store internal compartment temperature each time the refrigerator door is ajar or open. For example, it may be the case that although the internal storage space temperature has not yet reached an overly high temperature, the trend is that the storage space temperature is increasing. The ability to detect such a trend may enable the refrigerator owner to attend to repairs before the repairs become major. In the simplified schematic of FIG. 4, an analog/digital converter 90 digitizes the transducer detected storage space temperature each time the refrigerator door is opened, e.g., when operating potential is available. The digitized value may be stored in a non-volatile memory unit 92 whose memory contents are interrogated by a simple central processor unit 94 to develop a temperature change trend, denote "Δ". When a trend indicating increasing temperature is noted, e.g., suggestive of on-going refrigerator mechanism disfunction, unit 86 can be caused to trigger an alert, using one or more signal devices such as 72, 74.

In yet another embodiment, if desired, transducer 74 may include a wireless transmitter sending a signal to a nearby receiver 96 to which is coupled one or more transducers 98 and 100. Of course the emanations from transmitter 74 must be sufficiently strong to be received outside of the refrigerator. If desired a small insulated wire antenna could be attached to the transmitter and glued to the interior of the refrigerator door opening or tucked within the rubber or plastic sealing gasket that surrounds the opening. Such a transmitter-receiver embodiment is especially useful for hearing impaired individuals. Output transducer 98 could include a speaker or other sound transducer whereas transducer 100 could provide a visual rather than an audible warning signal. Receiver 96 would be placed within receiving range of the refrigerator.

Modifications and variations may be made to the disclosed embodiments without departing from the subject and spirit of the invention as defined by the following claims.

What is claimed is:

1. For use with a refrigerator having an internal light that activates when the refrigerator door is ajar, a method of signalling an alarm when the refrigerator door remains ajar, the method comprising the following steps:

(a) removing said internal light from said refrigerator;

(b) attaching a warning device to said refrigerator in lieu of said internal light, wherein said warning device receives operating potential from said refrigerator when said door is ajar;

(c) said warning device measuring from presence of said operating potential approximate time said refrigerator door is ajar, and if measured said approximate time exceeds a predetermined threshold, said warning device signals said alarm.

2. The method of claim 1, further including attaching said internal light to said warning device such that when said refrigerator door is open, said light is activated.

3. The method of claim 1, wherein said potential is AC potential, and step (c) includes counting cycles of said AC potential provided by said refrigerator to said device when said door is ajar to measure said approximate time.

4. The method of claim 1, wherein said potential is AC potential, and step (c) includes time-integrating voltage pulses generated from said AC potential provided by said refrigerator to said device when said door is ajar to measure said approximate time.

5. The method of claim 1, wherein step (c) includes generating a current-driven voltage ramp while said door is ajar, and measuring magnitude of said voltage ramp to measure said approximate time.

6. The method of claim 1, wherein said alarm is signalled audibly.

7. The method of claim 1, wherein said alarm is signalled visually.

8. The method of claim 1, wherein said alarm is signalled wirelessly.

9. The method of claim 1, further including:

(d) said warning device measuring temperature within said refrigerator and, when said door is ajar, storing said measured temperature.

10. The method of claim 1, further including:

(d) said warning device measuring temperature within said refrigerator and, when said door is ajar, comparing said measured temperature with a predetermined threshold temperature and signaling an alarm when said predetermined threshold temperature is exceeded.

11. The method of claim 1, further including:

(d) said warning device measuring temperature within said refrigerator and, when said door is ajar, storing said measured temperature; and (e) when said door is ajar, determining whether stored measured temperatures indicate a warming trend, and if said warming trend is determined signaling an alarm.

12. A retrofittably attachable door ajar warning device for use with a refrigerator having a light receptacle to which an internal light may be removably attached for activation when the refrigerator door is ajar, the device comprising:

a housing including an adaptor sized to matingly attach to said light receptacle after removing said internal light therefrom;

circuitry, disposed within said housing, coupled to said adaptor to receive AC potential from said refrigerator when said refrigerator door is ajar;

said circuitry including means for measuring from presence of said AC potential length of time said refrigerator door is ajar; and said circuitry further including means for signalling an alarm when measured time said refrigerator door is ajar exceeds a predetermined threshold.

13. The device of claim 12, further including:

a light receptacle, attached to said housing, to which said internal light may be matingly affixed such that when said refrigerator door is ajar, said light is activated.

14. The device of claim 12, wherein said means for measuring includes a counter that counts cycles of AC potential.

15. The device of claim 12, wherein said means for measuring includes an analog integrator that integrates a signal proportional to said AC potential.

16. The device of claim 15, wherein said analog integrator is selected from a group consisting of (i) a voltage integrator, and (ii) a current integrator.

17. The device of claim 12, wherein said alarm includes at least one alarm selected from a group consisting of (i) an audible alarm, (ii) a visual alarm, and (iii) a wirelessly transmitted alarm.

18. The device of claim 12, wherein said circuitry further includes:

means for measuring temperature within said refrigerator.

19. The device of claim 12, wherein said circuitry further includes:

a temperature sensor that measures temperature within said refrigerator; and memory coupled to said temperature sensor to, when said refrigerator door is ajar, store measured said temperature.

20. The device of claim 12, wherein said circuitry further includes:

a temperature sensor that measures temperature within said refrigerator;

memory coupled to said temperature sensor to, when said refrigerator door is ajar, store a new value of measured said temperature; and processing means coupled to said memory to evaluate any refrigerator warming trend from stored values of measured temperature and, if said warming trend is identified, causing an alarm to signal.

* * * * *